United States Patent [19]

Hollitscher

[11] 4,100,382

[45] Jul. 11, 1978

[54] PERMANENT MAGNET LATCH FOR SPEED SWITCHING DEVICE

[75] Inventor: Herbert Hollitscher, Peterborough, Canada

[73] Assignee: Canadian General Electric Co., Ltd., Toronto, Canada

[21] Appl. No.: 774,356

[22] Filed: Mar. 4, 1977

[30] Foreign Application Priority Data

Jul. 30, 1976 [CA] Canada ..... 958247

[51] Int. Cl.[2] ..... H01H 35/00

[52] U.S. Cl. ..... 200/61.46; 200/61.39; 310/68 E; 310/190

[58] Field of Search ..... 200/61.39, 61.46; 310/190–193, 168–171, 68 R, 68 B, 68 E, 117; 318/465, 470; 335/219, 236

[56] References Cited

U.S. PATENT DOCUMENTS

| | | | |
|---|---|---|---|
| 2,540,845 | 2/1951 | Thomas | 310/190 |
| 2,610,993 | 9/1952 | Stark | 310/190 |
| 2,670,448 | 2/1954 | Bell et al. | 310/190 X |
| 2,825,828 | 3/1958 | Ling | 310/190 X |
| 2,833,879 | 5/1958 | Naul | 310/68 E |
| 3,080,494 | 3/1963 | Lundin et al. | 310/190 X |
| 4,027,229 | 5/1977 | Frink | 310/190 X |
| 4,054,764 | 10/1977 | Whiteley | 200/61.46 |

*Primary Examiner*—Donovan F. Duggan
*Attorney, Agent, or Firm*—Vale P. Myles

[57] ABSTRACT

A speed switch for a motor has an electrically conductive disc which rotates with the rotor of the motor. A drag member adjacent the disc is mounted for limited pivotal movement and has a permanent magnet linked magnetically with the disc to cause electromagnetic interaction resulting in a force on the drag member which varies with the speed of rotation of the disc. A switch is operated by a movement of the drag member to actuate an alarm or to actuate a protective device for the motor. An improved latching means restrains the drag member from movement until a predetermined rotational speed of the disc is reached. A screw is mounted so that it can be advanced into the gap and withdrawn therefrom to provide a finely adjustable magnetic shunt. The adjustment of the shunt varies the magnetic latching force and thereby the speed causing actuation of the switch.

7 Claims, 4 Drawing Figures

PERMANENT MAGNET LATCH FOR SPEED SWITCHING DEVICE

This invention relates to an improved permanent magnet latch for a speed switch. In particular the invention relates to an improved magnetic latch for use in a switching arrangement which is responsive to the speed of a rotating member to switch from one operating condition to another at a preset speed.

For many years it has been well known to fit large DC motors with an overspeed switching device. This has been done to protect the motor against the destructive effects of excessive speeds. Overspeed protection is considered necessary because certain combinations of field excitation and armature voltage and current can cause speeds in excess of the mechanical capabilities of the machine.

In copending Canadian patent application Ser. No. 228,772 in the name of Whiteley, filed June 5, 1975 and assigned to the same assignee as the present invention, there is described an overspeed switch for a motor where the switch uses a permanent magnet latching mechanism. The permanent magnet speed switch of the aforementioned Canadian patent application overcomes disadvantages in the prior mechanical type of overspeed switch where there is an assembly of weights, pivots, linkages and springs that rotate with the motor. In mechanical type overspeed switches the weights are arranged so that rotation of the motor creates forces which increase with rotational speed and act against springs. At a preset speed the forces overcome the spring restraint sufficiently to actuate a switch which initiates an alarm or shuts down the motor. In the mechanical type of overspeed switch the parts rotate and are subject to vibration, wear, corrosion and relaxing of the springs. This reduces their reliability. The permanent magnet overspeed switch of the aforementioned Canadian application uses an arrangement where the switching components do not rotate and where a permanent magnet latching means is used. A drag mechanism is mounted adjacent a copper or aluminum disc that rotates with the motor and has a permanent magnet structure linked magnetically with the disc. The drag mechanism is pivotally mounted and has an armature. The speed of the disc develops a force in the drag mechanism, proportional to the speed, which tends to cause movement of the armature. Movement of the armature is restrained by a latching mechanism where teeth on the armature are opposed to two pole elements of a permanent magnet assembly. When the force on the armature is sufficient it overcomes the magnetic attraction between the teeth and poles and moves rapidly to another position. The movement operates a switch.

The latching mechanism comprises, in more detail, permanent magnet means fixed between two sheet metal side plates which extend in planes parallel to the plane of the disc. The side plates are formed asymetrically at one end of the permanent magnet means into a pair of poles with faces opposed to respective teeth in the armature. The side plates extend at the other end of the permanent magnet means. A bolt is secured to one side plate extending through a large circular hole in the other side plate. A cylindrical shunt member is screwed onto the bolt and is moved up and down within the hole to provide a variable magnetic shunt to adjust the latching mechanism.

It has been found that the latching mechanism described above which forms part of the permanent magnet speed switch of the aforementioned Canadian patent application, does not adjust with sufficient accuracy and fineness of adjustment under all circumstances. Further, under some circumstances the latching forces or restraining forces may not be adequate.

It is a feature of this invention to provide an improved permanent magnet latching means for use in an overspeed switch.

Briefly, the latching means is for use in a speed switch for a motor that has an electrically conductive disc member supported for rotation with the rotor of the motor. A drag mechanism is pivotally mounted adjacent the disc member for limited movement and it has a permanent magnet which is linked magnetically with the disc member for causing a force on the drag mechanism through electromagnetic interaction between the magnet and the disc member during rotation of the disc member. The force is proportional to the speed of the disc member and thus to the speed of the motor. A switching means is actuated by movement of the drag mechanism. A latching means restrains the movement of the drag mechanism until the electromagnetic interaction develops a predetermined force, overcoming the latching force and permitting movement of the drag mechanism which actuates the switching means at a predetermined speed. The latching means comprises a permanent magnet means, preferably a rare earth magnet, which has a width, height and thickness. This is mounted with its height dimension in a direction at right angles to the plane of the disc member. A pole piece is on either side of and engaging the permanent magnet means. The pole pieces, at one end thereof, project towards the drag mechanism and terminate in a wedge shaped flux concentrating configuration. The drag mechanism has at least three teeth and two of these, that are separated by at least one tooth, are each opposed to a respective terminating wedge shaped end of a pole piece. The pole pieces extend in an opposite direction from the wedge shaped ends and have arm portions extending towards one another forming a gap therebetween. A magnetic shunt means is mounted so that it can be moved into position between the arm portions into the gap therebetween and withdrawn therefrom to adjust the amount of shunted flux and thereby to adjust the latching force with accuracy.

Accordingly, there is provided in one form of the invention, in an overspeed switch for a motor, an electrically conductive disc supported for rotation with the rotor of a motor, a drag member supported adjacent said disc for limited pivotal movement about an axis at right angles to the plane of the disc and having a permanent magnet linked magnetically with said disc for causing a force on said drag member through electromagnetic interaction between said permanent magnet and the rotating disc, said force varying with the speed of rotation of said disc, switching means connected to said drag member and actuated by said limited movement of said drag member, and an improved latching means for restraining said drag member from said limited movement until a predetermined force is developed by said electromagnetic interaction, said latching means comprising a permanent magnet means having a length, height and thickness mounted with its height extending in a direction at right angles to the plane of said disc and its thickness extending in a plane parallel to the plane of said disc, a pole piece on either side of and engaging said permanent magnet means, said pole pieces defining the thickness of said permanent magnet means, said pole pieces projecting towards said drag member and each terminating in a wedge-shaped, flux concentrating configuration, the terminating end of the wedge extending in a direction parallel to the height of said permanent magnet means, the drag member having at least three teeth in an arcuate arrangement about the axis of pivotal movement of said drag member, two of said teeth being separated by at least one intermediate tooth and each one of the said two teeth being located opposite to and closely spaced from a respective one of said terminating wedge-shaped ends of said pole pieces, said pole pieces also extending in a direction opposite said terminating wedge-shaped ends and having arm portions extending towards one another and terminating short of one another to define a gap therebetween, and a magnetic shunt means mounted for movement into a position bridging said gap and into a position withdrawn from said gap for adjustment of the amount of shunted flux and thereby the flux linking the pole pieces and the respective teeth of said drag member to adjust the operating level of said switching means with regard to the rotational speed of the disc.

The invention will be described in more detail with reference to the accompanying drawings, in which.

Figure 1:
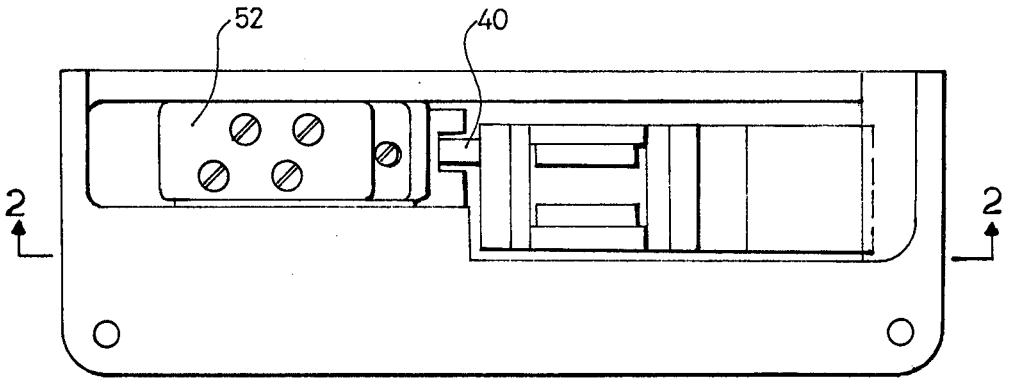
FIG. 1 is a top view of the overspeed switch of the invention.

Referring now to the drawings, (particularly FIG. 2) a disc 10 of electrically conductive material, such as copper or aluminum for example, is attached to the shaft of the rotor of a motor (not shown) for rotation with the motor shaft. A drag member 11 is pivotally mounted on a pin 12 to a frame 14. The pin 12 and drag member 11 pivot together. The drag member 11 has a pair of opposed arms 15 and 16 which extend on either side of disc 10. Each arm 15 and 16 carries a respective permanent magnet 17 and 18 mounted on the inside thereof so that the magnets 17 and 18 are on opposite sides of disc 10 and closely spaced from disc 10. The magnets 17 and 18 provide a magnetic field which interacts with disc 10 as it rotates. The interaction of the field from magnets 17 and 18 and the rotating disc 10 causes a drag force on the drag member 11 which varies with the rotational speed of disc 10.

The drag member 11 has three teeth 20, 21 and 22 which preferably extend from top to bottom of the drag member. Mounted to frame 14 are a pair of similar pole pieces 23 and 24 with a permanent magnet means between the pole pieces 23 and 24 and in engagement with the pole pieces. The permanent magnet means is oriented with its pole faces engaging the pole pieces. The permanent magnet means may comprise two permanent magnets 25 and 26 as shown. The magnets 25 and 26 are preferably rare earth magnets, providing a strong field. The permanent magnet means, comprising magnets 25 and 26, has a length, a height and a thickness and is arranged so that its height dimension extends in a direction at right angles to the plane of the disc 10, its thickness dimension is from pole piece 24, and its length dimension is generally in a radial direction from pin 12. The pole pieces may be provided with holes extending in the height direction to accommodate mounting screws 30 and 31 to mount the pole pieces to frame 14. The pole pieces 23 and 24 with the magnets 25 and 26 have a symmetrical configuration.

Figure 2:
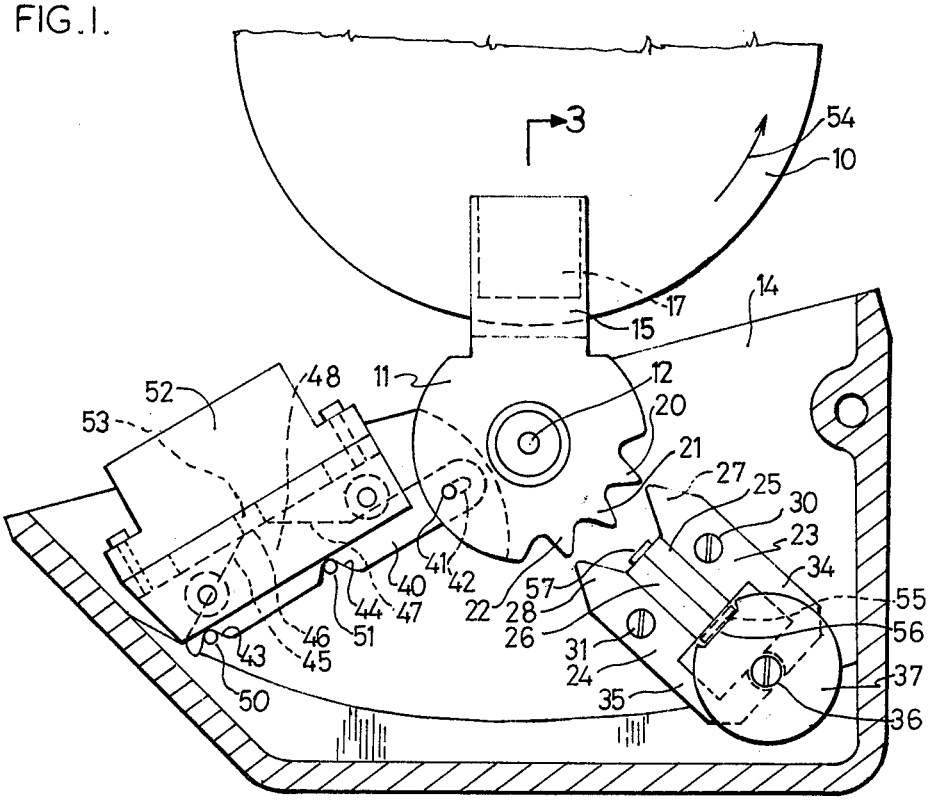
FIG. 2 is a side elevation of the switch.

The pole pieces 23 and 24 each terminate at one end thereof in a respective wedge-shaped, flux concentrating configuration. These terminating wedge-shaped ends 27 and 28 respectively of pole pieces 23 and 24 are opposed to teeth 20 and 22 when the drag member 17 is in the normal position shown in FIGS. 2 and 4. Thus, the tooth 21 is intermediate the wedge-shaped ends 27 and 28. It will be seen that the permanent magnets 25 and 26 provide a magnetic field which is concentrated at the wedge-shaped ends 27 and 28 of pole pieces 23 and 24 so that a magnetic circuit is completed via teeth 20 and 22 and the body of drag member 11. This magnetic field provides a restraining force tending to hold drag member 11 with teeth 20 and 22 opposite the wedge-shaped ends 27 and 28. However, if sufficient force is applied to drag member 11 in one direction, (counter clockwise about pin 12 as seen in FIG. 2) it will rapidly pivot so that tooth 21 is opposite wedge-shaped end 27, and if the force is applied in the other direction it will rapidly pivot to a new position with tooth 21 opposite wedge-shaped end 28. In other words, when sufficient force is applied to drag member 11 it will pivot to a new position by a pivotal movement of one tooth distance.

The permanent magnets 25, 26 with pole pieces 23, 24 and co-operating teeth and body of the drag member 11 may be referred to as the latching means or restraining means.

Pole pieces 23 and 24 have portions 32 and 33 (see FIG. 4) which extend in a direction opposite the terminating wedge-shaped ends 27 and 28. The portions 32 and 33 have arms 34 and 35, respectively, which extend towards one another and terminate short of one another to form a gap therebetween. In a preferred form of the invention the facing surfaces of arms 34 and 35 are threaded to receive a screw 36 which acts as an adjustable magnetic shunt. A disc 37 of non-magnetic material, such as for example, brass, may be adhered to the exposed surface of pole pieces 23 and 24 by an epoxy adhesive. A hole 38, in disc 37 is provided so that screw 36 may be completely withdrawn from between the ends of arms 34 and 35. Thus, screw 36 may be advanced into position between arms 34 and 35 or withdrawn to provide a fine adjustment of the amount of magnetic field shunted by portions 32 and 33 and arms 34 and 35 of pole pieces 23 and 24. This adjustable shunt can vary the field extending from pole pieces 23 and 24 through teeth 20 and 22 and thus can vary the amount of force required to rotate drag member 11. The drag member can, in this manner, be set quite accurately so that it is magnetically restrained until a predetermined rotational speed of disc 10 is reached (which corresponds to a predetermined rotational speed of the motor to which it is attached), and then the drag member 11 pivots to a new position. The drag member 11 is normally prevented from pivotal movement beyond one tooth position either side of the normal or central position shown in FIGS. 2 and 4. The size of magnets 25, 26 and of portions 32, 33 and arms 34, 35 are selected so that an appropriate range of flux shunting is achieved to provide a satisfactory setting for operating speed.

Drag member 11 carries a pin 41 (see FIG. 2) which passes through a slot 42 in actuator 40. The actuator 40 has a pair of notches 43 and 44 on one edge and a cam 48 having a cam surface identified by numerals 45, 46 and 47 on the opposite edge, as shown. A pair of pins 50 and 51 mounted to Frame 14 engage notches 43 and 44 respectively. A switch 52 with an operating member 53 is mounted to frame 14. The operating member 53 is spring biased outwardly and bears against cam 48. Thus, the operating member 53 bears against cam surface 46 of cam 48 which presses actuator 40 against pins 50 and 51 in the position shown in FIG. 2. In this position the switch 52 is in its normal condition and drag member 11 is in its neutral position.

The operation of the improved magnetic latch for a speed switch will become clearer from the following description. Assuming the disc 10 is rotating in the direction indicated by arrow 54 in FIG. 2, it will generate a drag force in drag member 11 tending to cause it to rotate in a clockwise direction about pin 12. If the drag member 11 is in its neutral position (as in FIG. 2) the teeth 20 and 22 will be opposite wedge-shaped ends 27 and 28 of pole pieces 23 and 24 respectively. The magnetic field, as concentrated by the pole pieces with their wedge-shaped ends, will tend to retain the drag member 11 in its neutral position. When a predetermined rotational speed is reached, the drag force will overcome the magnetic retaining force, causing drag member 11 to rotate in a clockwise direction so that tooth 21 is opposite wedge-shaped end 28 of pole piece 24. The pin 41 in drag member 11 will move actuator 40 causing it to pivot about pin 50 and pressing cam surface 47 against operating member 53 of switch 52 to depress operating member 53 and operate the switch. Similarly, if disc 10 is rotating in a direction opposite to arrow 54 of FIG. 2, it will generate a drag force tending to rotate drag member 11 in a counter-clockwise direction. The magnetic field from magnets 25, 26, as concentrated by the pole pieces 23, 24 with their wedge-shaped ends 27, 28, will tend to retain the drag member 11 in its neutral position. When a predetermined rotational speed is reached in this direction, the drag force will overcome the magnetic retaining force, causing drag member 11 to rotate in a counter-clockwise direction so that tooth 21 is opposite wedge-shaped end 27 of pole piece 23. The pin 41 in drag member 11 will move actuator 40 causing it to pivot about pin 50 and pressing cam surface 45 against operating member 53 of switch 52 to depress operating member 53 and operate the switch. It will be seen that once a predetermined rotational speed is reached in either direction, the switch 52 will be operated. The switch 52 may be connected to a warning circuit or may be connected to trip a protective device.

It is desirable to be able to test the speed switch at a rotational speed which is less than the predetermined speed where it normally operates. A shunt 55 is provided for this purpose. The shunt 55 is not used for normal operation. When it is desired to test the speed switch, shunt 55 is placed against the magnets 25, 26 by inserting it through a slot or recess 56 in disc 37. This reduces the restraining field available at the wedge-shaped ends 27 and 28 of pole pieces 23 and 24 and the drag member 11 will now change from its neutral position at a speed less than the predetermined speed at which the speed switch normally operates. The shunt adjusting screw 36 need not be touched. When shunt 55 is removed the speed switch will once more operate at its normal predetermined speed.

Figure 4:
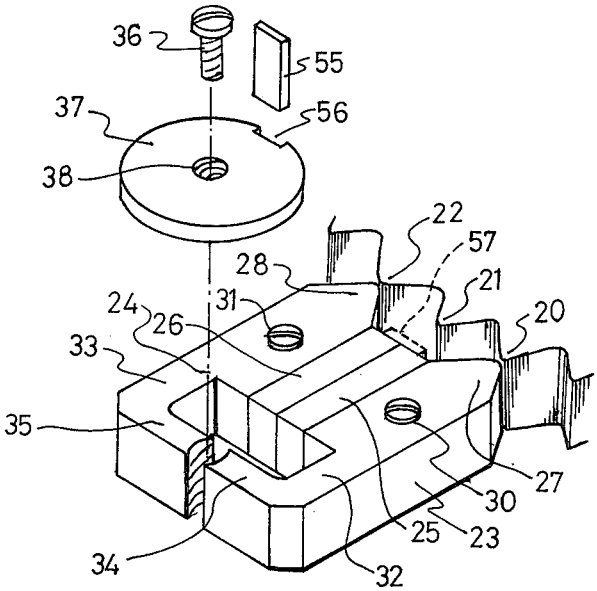
FIG. 4 is an isometric view, partially exploded, of the magnetic latching arrangement.

Ambient compensation may be accomplished by known techniques, for example, by using a temperature compensating shunt 57 (FIGS. 2 and 4).

Figure 3:
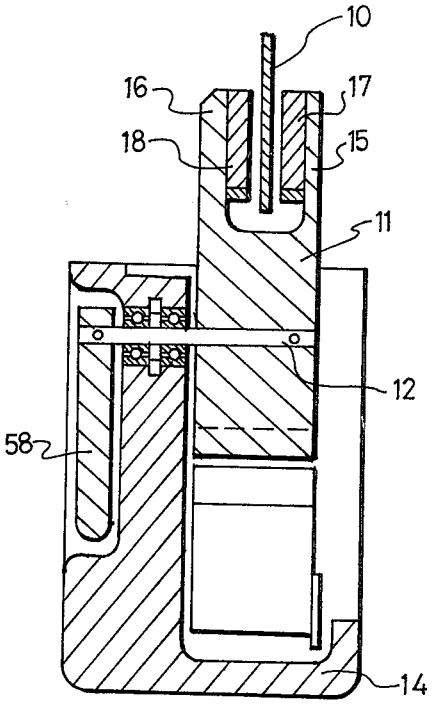
FIG. 3 is a sectional view taken along line 3—3 of FIG. 2.

When the overspeed switch has operated, it may be manually reset to its normal or neutral position by rotation of handle 58 which is fixed to pin 12. This is shown in FIG. 3.

The speed switch according to the present invention has a strong retaining force applied to drag member 11 through symmetrical pole pieces 23 and 24 with their flux concentrating, wedge-shaped ends 27 and 28. The screw 36 provides a fine adjustment of the shunted magnetic field and consequently of the latching force or retaining force and operating speed.

The embodiments of the invention in which an exclusive property or privilege is claimed are defined as follows:

1. In a speed switch for a motor, an electrically conductive disc supported for rotation with the rotor of a motor, a drag member supported adjacent said disc for limited movement and having a permanent magnet linked magnetically with said disc for causing a force on said drag member through electromagnetic interaction between said permanent magnet and the rotating disc, switching means actuated by said limited movement of said drag member, and an improved latching means for restraining said drag member from said limited movement until a predetermined force is developed by said electromagnetic interaction, said latching means comprising a permanent magnet means having a length, height and thickness mounted with its height in a direction at right angles to the plane of said disc and its thickness extending in a plane parallel to the plane of said disc, a pole piece on either side of and engaging said permanent magnet means, said pole pieces defining the thickness of said permanent magnet means, said pole pieces projecting towards said drag member and each terminating in a wedge-shaped, flux concentrating configuration, the drag member having at least three teeth, two of said teeth being separated by at least one intermediate tooth and each one of said two teeth being located opposite to and closely spaced from a respective one of said terminating wedge-shaped ends of said pole pieces, said pole pieces also extending in a direction opposite said terminating wedge-shaped ends and having arm portions extending towards one another and terminating short of one another to define a gap therebetween, and a magnetic shunt means mounted for movement into a position in said gap between said arm portions and into a position withdrawn from said gap for adjustment of the amount of shunted magnetic flux and thereby the latching force.

2. In an overspeed switch for a motor, an electrically conductive disc supported for rotation with the rotor of a motor, a drag member supported adjacent said disc for limited pivotal movement about an axis at right angles to the plane of the disc and having a permanent magnet linked magnetically with said disc for causing a force on said drag member through electromagnetic interaction between said permanent magnet and the rotating disc, said force varying with the speed of rotation of said disc, switching means connected to said drag member and actuated by said limited movement of said drag member and an improved latching means for restraining said drag member from said limited movement until a predetermined force is developed by said electromagnetic interaction, said latching means comprising a permanent magnet means having a length, height and thickness mounted with its height extending in a direction at right angles to the plane of said disc and its thickness extending in a plane parallel to the plane of said disc, a pole piece on either side of and engaging said permanent magnet means, said pole pieces defining the thickness of said permanent magnet means, said pole pieces projecting towards said drag member and each terminating in a wedge-shaped, flux concentrating configuration, the terminating end of the wedge extending in a direction parallel to the height of said permanent magnet means, the drag member having at least three teeth in an arcuate arrangement about the axis of pivotal movement of said drag member, two of said teeth being separated by at least one intermediate tooth and each one of said two teeth being located opposite to and closely spaced from a respective one of said terminating wedge-shaped ends of said pole pieces, said pole pieces also extending in a direction opposite said terminating wedge-shaped ends and having arm portions extending towards one another and terminating short of one another to define a gap therebetween, and a magnetic shunt means mounted for movement into a position bridging said gap and into a position withdrawn from said gap for adjustment of the amount of shunted flux and thereby the flux linking the pole pieces and the respective teeth of said drag member to adjust the operating level of said switching means with regard to the rotational speed of the disc.

3. The invention as defined in claim 1 in which said permanent magnet means is a rare earth permanent magnet.

4. The invention as defined in claim 2 in which the height of the permanent magnet means is substantially the same as the height of the pole pieces.

5. The invention as defined in claim 2 in which the terminating ends of said arm portions are threaded, and in which said magnetic shunt means is a screw engaging the threaded ends of said arm portions whereby rotation of the screw in one direction will advance the screw into the gap between the arm portions and rotation of the screw in the opposite direction will withdraw the screw from said gap.

6. The invention as defined in claim 5 and further including a nonmagnetic support means adjacent said arm portions and having a threaded opening aligned with the threaded terminating ends of said arm portions to support said screw in a position where it is completely withdrawn from said gap.

7. The invention defined in claim 2 and further comprising a fixed magnetic shunt for mounting temporarily against said permanent magnet means and between said arm portions for shunting an additional amount of flux to decrease the latching force and lower the speed of rotation of the disc which actuates the switching means to enable to check of the operation of said overspeed switch at a lower than normal speed.

* * * * *

UNITED STATES PATENT AND TRADEMARK OFFICE

CERTIFICATE OF CORRECTION

PATENT NO. : 4,100,382

DATED : July 11, 1978

INVENTOR(S) : Herbert Hollitscher

It is certified that error appears in the above-identified patent and that said Letters Patent are hereby corrected as shown below:

In the heading [30]:
Please correct Canadian Serial Number to read 258,247.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*